United States Patent [19]

Greenberg

[11] 4,068,618

[45] Jan. 17, 1978

[54] APPARATUS FOR MAKING MATERIAL WITH FUSIBLE BACKING

[75] Inventor: Robert Greenberg, New York, N.Y.

[73] Assignee: Trufuse International Ltd., Long Island City, N.Y.

[21] Appl. No.: 653,596

[22] Filed: Jan. 29, 1976

[51] Int. Cl.[2] ..... B05C 19/00

[52] U.S. Cl. ..... 118/60; 118/69; 118/406

[58] Field of Search ..... 427/197; 118/60, 50, 118/213, 69, 406, 301, 308; 101/119, 120; 93/77 FT

[56] References Cited

U.S. PATENT DOCUMENTS

| | | | |
|---|---|---|---|
| 2,792,780 | 5/1957 | Jacob | 101/119 |
| 3,002,849 | 10/1961 | Harmon et al. | 427/197 X |
| 3,245,341 | 4/1966 | Childress et al. | 427/197 X |
| 3,667,422 | 6/1972 | Saladin | 118/60 X |
| 3,814,052 | 6/1974 | Caratsch | 118/60 |

*Primary Examiner*—John P. McIntosh

[57] ABSTRACT

A material with a fusible backing is made by bringing a substrate into contact with a printing screen having fine polymer dust supplied to its other side and then bringing the substrate out of contact with the screen and heating it from below to fuse the polymer to the substrate.

15 Claims, 6 Drawing Figures

PRIOR ART
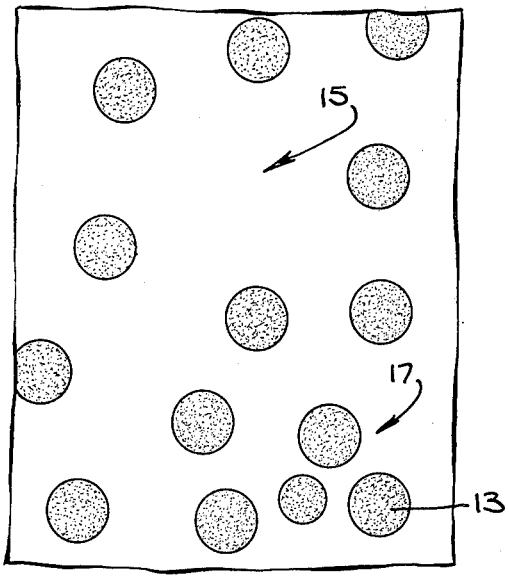
Fig. 1.
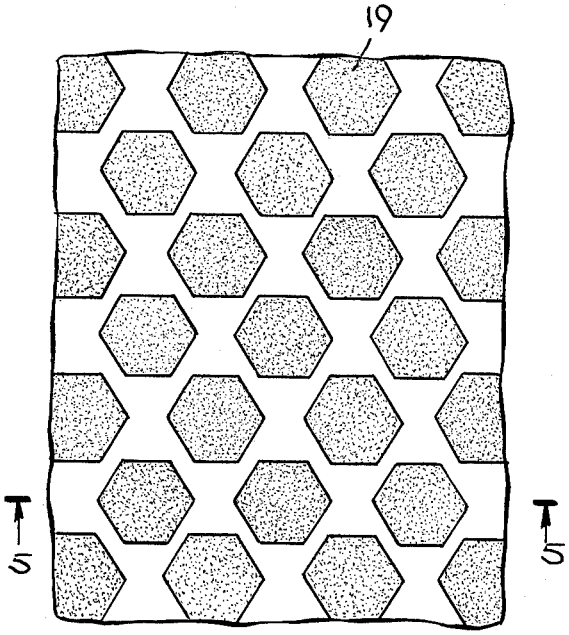
Fig. 2.
Fig. 5.
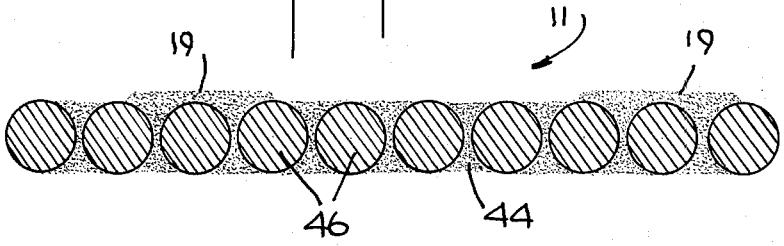
Fig. 6.
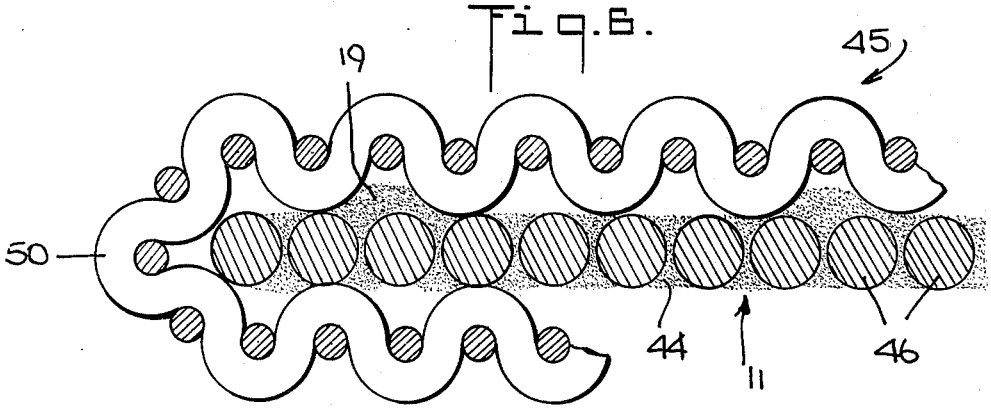

APPARATUS FOR MAKING MATERIAL WITH FUSIBLE BACKING

BACKGROUND OF THE INVENTION

This invention relates to the manufacture of material with a fusible backing in general and more particularly to an improved apparatus for making such fusible material using a dry printing process.

Fusible interlinings are universally used in the manufacture of various articles of clothing. In general, such interlinings comprise a lining substrate, e.g., woven fabric, nonwoven, paper knitted fabric, etc., having polymeric material deposited thereon to permit the fusible interlining to be attached to the garment without the need for sewing by means of fusion through simultaneous heating, pressing or the like. Similarly, fusible backing is used in making iron-on patches and the like.

Various methods have been developed in the prior art for making such fusible interlinings and the like, i.e. for applying the polymeric material to a substrate. Two general types of processes have been used. One is a random or scatter application of the polymer and the other method a discrete or controlled application. Most universally used is the random method in which a large number of particles are applied on a moving web. The polymer particles of a relatively large size are usually gravity fed from a feeder hopper located above the moving web which forms the substrate fabric. After being randomly coated with these particles, the web then passes under a heat source where the polymeric material is heated to its tackifying or melt point, after which it is calendered or pressed, cooled and then rolled up. The process is relatively simple and has been used to produce great quantities of fusible interlinings over the years. However, even with the development of highly usable polymeric materials such as polyamide, terpolymers, polyester polymers HDPE, urethanes, etc., the optimum application and functioning of a scatter product are limited because of the random laydown and the large particle size.

Discrete or controlled methods of applications are much less common even through the fusible product is superior in function and application. The primary reason for this is the increased difficulty in producing the fusible lining using known methods. In general, the controlled methods are printing methods. Both wet and dry printing methods have been used. A summary of the methods used is given in an article entitled "Copolymeric Nylon Powders for Fusing Textiles" by Schaaf in the November 1972 issue of American Dyestuff Reporter. More detail is given in a similar article by the same author titled "Lannion sin costra" reprinted from Textiles Panamericanos. In one method known as the powder point method a dry powder is doctored onto an engraved steel roll. The engraved dots are filled with the dry powder. The substrate is preheated and then pressed against the cool engraved steel roll causing particles of polymer to stick to the heated substrate so that the dry powder is lifted out of the engravings. Thereafter, the substrate with the polymer still virtually a powder moves into an area of high heat, normally an infra-red radiant heating system where the polymer is reheated to a high temperature to bring it to a semi-plastic state after which calendering of pressing completes the process of attaching the molten polymer to the substrate. Even this process which comprises a large number of steps and results in a better product than the random method, has disadvantages. Since the polymer is primarily heated from above, the additional calendering or pressing step is necessary. Even with this step, the binding of the polymer to the substrate fabric does not reach an optimum. The above mentioned article from Textiles Panamericanos does describe a powder point process in which the engraved steel roll is followed by a heated roll.

A silk screen method is also known. An aqueous paste is squeezed through a rotary screen equipped with an adjustable squeegee. The material is then heated or sintered in an elongated infra red heating apparatus. In an alternate of this method powder is dusted on the substrate resulting in a random application before heating. This arrangement requires a great deal of space and still does not obtain optimum bonding of the polymer material to the substrate. Typically infra-red ovens are 20 to 30 feet long.

In view of these variaous difficulties with prior art processes, the need for an improved process which is simpler and insures inadequate bonding of the polymer to the substrate becomes evident.

SUMMARY OF THE INVENTION

The present invention provides apparatus which solves these problems. In general terms, the present invention comprises bringing the substrate fabric at ambient conditions into contact with a printing screen which has a fine polymer dust applied to its other side and maintaining the fabric and a screen in contact for a sufficient time over a long enough distance for the polymer dust to be deposited on the substrate through all openings in the screen in the desired quantity. Thereafter the substrate is heated from below causing the polymer to fuse to the substrate without the need for subsequent heat treatment.

A particularly advantageous embodiment of the invention is illustrated in which the printing screen is a conventional rotary textile print screen to the inside of which a fine polymer dust is fed from a hopper located thereabove. The substrate material is fed from a roll (or fed continuously) and held in contact with the printing drum over approximately 170° of its circumference to insure sufficient time for the polymer particles to fill all openings in the screen and contact the substrate. The substrate now covered with dots consisting of many particles of polymer dust thereon leaves the screen printing area and travels more or less horizontally and vibrationless to the heating area where it the passes over and around a heated drum which heates the substrate from below causing the polymer particles to fuse into a single large homogeneous dot and to be bonded to the substrate. It is then cooled and rolled up ready for delivery without further processing. Through this process, maximum coverage of the substrate with the discontinuous film of polymer, maximum utilization of the polymer, no imparting of undesireable hand to the substrate and extremely high in-plant production speeds with a simplified process are possible. The process can be used with all types of substrates and polymers or blends of polymers. In particular, it should be noted that the present process can obtain speeds equal to that of the random or scatter process while obtaining better and more efficient coverage. Typically, scatter processes operate at 30–60 yards per minute whereas prior art powder-point processes normally operate at 9–10 yards per minute and are not known by applicant to have exceeded 15–25 yards per minute. The present apparatus has been operated at speeds in excess of 40 yards per minute with no problem. Furthermore, since elongated infra red heating ovens are not required, a particularly compact unit is obtained.

BRIEF DESCRIPTION OF THE DRAWINGS

FIG. 1 is a plan view of a fusible interlining manufactured using the prior art scatter process.

FIG. 2 is a plan view of similar material treated using the process of the present invention.

FIG. 5 is a cross section through the fusible interlining of FIG. 2.

FIG. 6 is a similar view illustrating the fusible interlining after attachment to another fabric.

DETAILED DESCRIPTION OF THE PREFERRED EMBODIMENT

Figure 3:
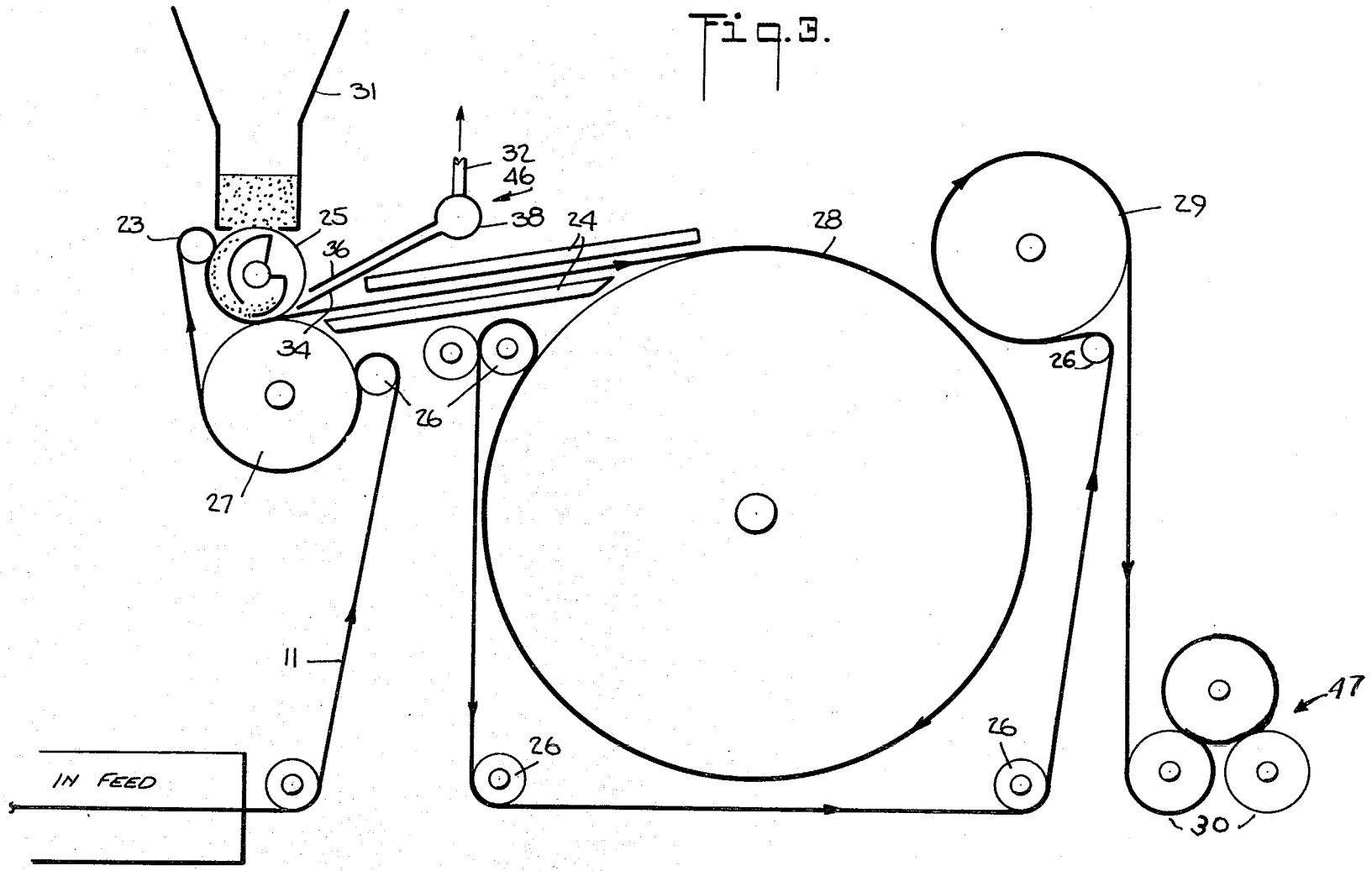
FIG. 3 is a schematic illustration of the processing apparatus of the present invention.

For purposes of comparison the effect obtained with the commonly used scatter process of the prior art is illustrated by FIG. 1. As shown, a plurality of polymer particles 13 are deposited in random fashion on a substrate fabric 11. Through this random deposit there will be relatively large areas such as the area 15 containing no polymer, whereas in other areas such as area 17 the polymer particles may become more closely packed than is desirable and sometimes overlap. Thus, this prior art method does not obtain even coverage, introduces the disadvantageous agglomerate and does not obtain maximum benefit of uniform adhesive for the amount of polymer used. Large sized particles are necessarily used so that the falling polymeric particles remain on the substrate surface and not fall into the cross section of the substrate or completely thru. Thus, very fine particles in the 1–80 micron range are virtually not practical or applicable unless the substrate is opaque otherwise, if the 1–80 micron range is used, the substrate is usually so completely coated as to constitute a continuous film.

The same substrate 11 treated with the printing process of the present invention is illustrated on FIG. 2. As indicated above, the process is carried out by maintaining the substrate in contact with a printing screen having supplied to its opposite side fine particles of polymer dust. The screen and substrate remain in contact long enough for the polymer dust to fill the openings in the screen and cover the full desired area on the substrate. Thereafter, the substrate is heated from below to bond the polymer to the substrate. The result, using a screen which have openings of hexagonal shape, is the deposit of polymer areas 19 is shown on FIG. 2. As illustrated, the areas where polymer is applied are evenly distributed and maximum utilization of the polymer is obtained.

The finished fused dot is the result of several steps. The printed dot directly after printing and before fusing consists of many separate polymer particles. Upon heating the particles melt coalesce into a single large spherical dot due to the natural forces of cohesion and internal surface tensions. Therefor the shape of the unfused powder dot will generally be transformed into a sphere no matter what its dry state configuration. The shape of the screen openings are the result of the manufacturing method of screen preparation. i.e., the hexagonal shape is only an example of one particular screen.

Apparatus for carrying out this process is illustrated by FIG. 3. The substrate material to be processed will be conventionally supplied as a mill roll. The substrate fabric material, 11, is fed from the mill roll over a path which delivers the web to compression (metering idler roll) roll 26. The web passes between rolls 26 and 27 where the web is locked onto roll 27. The purpose of this is to feed or meter the web 11 to the rotating rolls 25 and 27 in perfect synchronization. This lock-step is essential for producing a perfect print. The web can be delivered from the print roll 25 at any rate independent of the downstream processing equipment speeds. The web is then brought into contact with the print screen 25 by the idler roll 23. The substrate 11 is maintained in contact with the printing drum 25 over approximately 170° of its circumference. The fabric is then wound over a heated drum 28, which heats the fabric from below to fuse the polymer thereto. As shown, it is wrapped almost completely around this drum to obtain maximum heated contact. After passing over idler rollers 26 it is wound over a cooling drum 29 and then rollers 31 at a rewind station 47 where it is rewound in a roll.

Fine free-falling polymer dust is fed by a hopper 31 to the top of printing drum 25 entering through the openings therein to the inside of the drum, as an alternate it can be internally fed to eliminate the external hopper. Also shown are optional heating means, e.g. infra-red heaters, 24 between drums 25 and 28.

Figure 4:
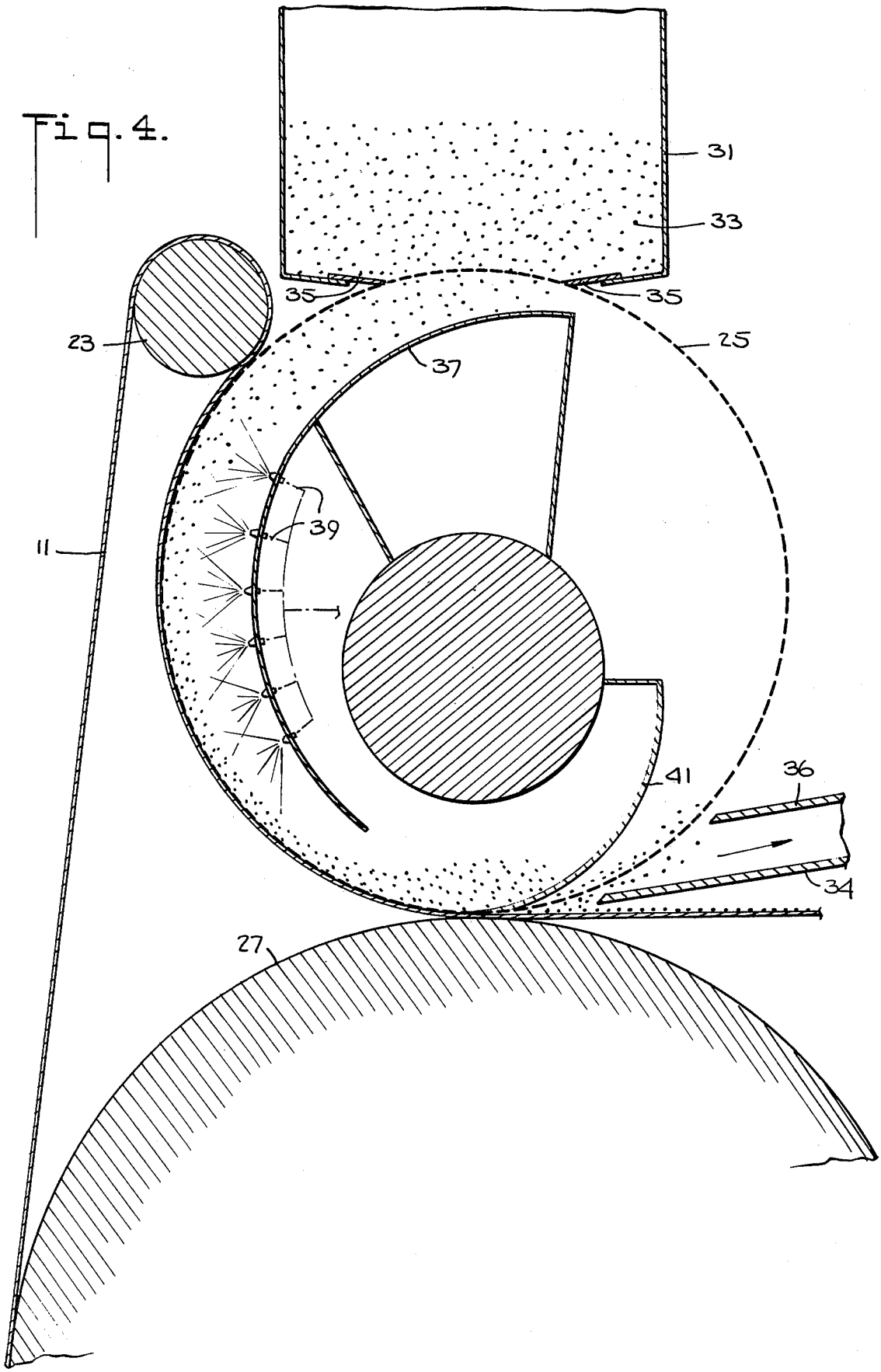
FIG. 4 is more detailed cross sectional view through the rotary printing screen of the apparatus of the present invention.

The operation of the printing drum can be better understood with reference to FIG. 4. Shown is the bottom of the hopper 31 which will contain therein an adequate supply of free-falling fine polymer dust 33. Associated with the bottom of the hopper 31 on each side is a doctor blade 35. These doctor blades 35, preferably of stainless steel, are made adjustable so that they can be brought into tangent contact with the screen drum 25 at any chosen point of tangent angle and contact pressure. The screen drum itself is a conventional rotary textile print screen. A suitable print screen is a 30 mesh, 25/1620 Stork Brabant commercial rotary print cressn. Although the present invention will operate with any polymeric material used for such purposes, e.g. see the various materials noted in the above literature references, polyamide powder of a particle size range of 1–80 microns and which is readily available commercially has been found to give good results.

As described above, the substrate 11 is brought over an idler roller 23 into contact with the edge of the printing screen 25. It is maintained in contact with the circumference of the screen 25 from that point to a point at its bottom where it contacts the large drum 27. Preferably, this distance is made as large as possible and as illustrated is approximately 170° of the printing drum's circumference. The fine polymer dust falls through the openings in the screen into the inside thereof. Inside the screen a flexible baffle plate 37 is provided to direct the falling polymer dust outward and downward into contact with the sides of the screen and through the screen openings into contact with the substrate 11. Although the centrifical force of the rotating drum along with the free-flowing powdery nature of the polymide will result in sufficient coverage with nothing further, a differential pressure between the inside and outside of the screen can further benefit this process. Means can be provided at the outside next to the substrate to draw a partial vacuum or, as illustrated, a plurality of air jets 39 fed from a conventional air supply, which aid in blowing the dust against the screen and thus bring it into contact with the substrate, may be used. Located at the bottom of drum 25 is a doctor blade 41. This doctor blade is arranged in a direction opposite to that which is normal in screen printing drums. Its function is to simply shear off excess powder rather than to extrude it as is normally done in paste printing or the dry powder methods described above.

The dot coated substrate then leaves the bite of the print head and continues to move horizontally in a vibrationless manner to the heated drum 28 of FIG. 3. As it leaves, powder which has been carried past the doctor blade 41 drops through the screen and acts to evenly coat the substrate with additional small particles. These get into the openings of the cross section of the substrate and after heating act to strengthen the fabric.

Apparatus for controlling the amount of material which is allowed through the screen to randomly coat the substrate is illustrated on FIG. 3. This apparatus indicated generally as 46 includes a vacuum manifold 38 coupled to a conventional vacuum source over a line 32. Extending from the vacuum manifold is a bottom plate 34 and a top plate 36. In conventional fashion, these two plates will be closed off at their sides to form a slot which will draw a vacuum tending to suck in the particles as they fall from the drum 25. In conventional fashion, the system 46 will be mounted so that the distance between the end of the slot formed by the plates 36 and 34 and its angle can be adjusted with respect to the drum 25 to control the amounts of powder falling out of the drum 25 which are allowed to fall onto the substrate and the amount which is collected in the vacuum system 46.

Heat is then applied by the drum 28 to the underside of the substrate and up through the substrate material to the underside of the polymer particles which melt and fuse to the substrate. By so bonding the polymer to the substrate, a superior bond between the substrate and polymer results as opposed to the commonly used prior method of applying heat from above. No calendering or pressing is required. As indicated in connection with FIG. 3, the finished material is cooled immediately on the drum 29 and can then be wound up for delivery to a customer.

The finished fusible interlining was described in connection with FIG. 2 which shows the pattern of polymeric material 19 on the substrate 11 after processing. A cross section of this material with the polymer material is shown on FIG. 5. This is the fusible interlining material which is supplied to a customer who then uses it for ling other material.

Shown on FIG. 5 is the manner in which the small particles 44 get into the cross section of the fabric or substrate between the individual threads 46. In fact, very little of this powder which drops through the screen as it is carried past the doctor plate ends up on the surface of the fabric. As a result, it has no particular effect on the normal fusing of the substrate to another fabric, e.g. a shell fabric. However, this does permit carrying out a special process which is illustrated on FIG. 6. In the first instance, the user applies the fusible liner comprising the substrate 11 with the dots of polymer 19 thereon with the polymer side down to a fabric 45 to be lined. Thereafter heat may be applied through pressing or the like to bond the two fabrics together without sewing. However, the presence of the small particles 44 within the cross section of the materials permits a further operation to be carried out as shown on the lefthand side of FIG. 6. As illustrated, the material 45 is longer than the substrate 11 and is brought around to the other side of the substrate. The top of the material to which the substrate is attached is the portion of the material which will be visible when the article of clothing is worn or the material used for some other purpose. The side 49 is the back of the material. Because these particles 44 penetrate the cross section of the substrate 11 they are available for this important crease and band operation so that the edge 50 of the fabric 45 can be brought around and tacked in place to the back of the substrate. Thus, the substrate produced by the present invention satisfies the double requirement of a full normal fusing plus the vitally important fusing which is used in the creasing and banding operation. The product is ideally suited initially for top fusing using the dots 19 which are normally a 30 mesh dot application. Furthermore, the additional property of bleed back due to the inclusion of the individual polymer particles 44 in the cross section of the substrate permits the refusing. It is also thought that the large dots during the pressing are caused to completely penetrate the fabric and aid in this refusing in the crease and band process.

Thus, an improved method for manufacturing a material with a fusible backing, such as fusible interlinings and iron on patches, and apparatus for carring out that method has been shown. Although specific embodiments have been illustrated and described, it will be obvious to those skilled in the art that various modifications may be made without departing from the spirit of the invention which is intended to be limited solely by the appended claims.

I claim:

1. Apparatus for manufacturing a fusible interlining consisting of a fabric substrate to which a fusible polymer is applied, comprising:

a. a rotating screen printing drum;

b. means for holding the substrate in contact with said drum over a substantial portion of its circumference;

c. means applying a free flowing polymer dust to the other side of said printing drum, said means feeding polymer dust to the inside of said drum over said portion with which said substrate is in contact;

d. means for removing said substrate from said screen after polymer dust has been deposited thereon;

e. a reverse doctor blade inside said drum arranged so as to scrape excess polymer material from the inside of said drum at the point where said substrate is removed from said drum; and f. means for heating said substrate with the polymer dust thereon from below.

2. Apparatus according to claim 1 wherein said heating means comprises a heated drum to which said substrate is directed after leaving the surface of said printing drum.

3. Apparatus according to claim 2 wherein said means holding said substrate in contact with said printing drum comprise a first roller located near the top of said printing drum and a second roller located near the bottom of said printing drum holding said substrate in contact with said drum at said points and wherein the point of contact between said second roller and said printing drum is at approximately the same level as the top of said heated drum whereby said substrate with said polymer dust thereon will be maintained vibrationless and close to the horizontal while moving therebetween.

4. Apparatus according to claim 3 wherein said means for providing said polymer dust to the inside of said drum comprises a hopper located thereabove.

5. Apparatus according to claim 4 and further including first and second doctor blades at the outlet of said hopper contacting said printing drum.

6. Apparatus according to claim 3 and further including a baffle in said drum extending from a point below said hopper to a position near the bottom of said drum to direct said polymer dust toward the outside of said screen and into contact with said substrate.

7. Apparatus according to claim 3 and further including means for synchronously supplying said substrate to said printing drum.

8. Apparatus according to claim 7 wherein said means for synchronously supplying comprise said second roller contacting said printing drum means driving said second roller in synchronism therewith, and a third roller bringing said substrate into contact with said second roller, said substrate passing around the bottom of said second roller to said first roller and thereby being locked in synchronism in with said printing drum.

9. Apparatus according to claim 7 and further including means for cooling the substrate after leaving said heating drum.

10. Apparatus according to claim 1 and further including means to create a differential pressure between the inside and outside of said drum at least over a portion of the area where said substrate is in contact with said printing drum.

11. Apparatus according to claim 10 wherein said means to create a differential pressure comprise air jets mounted to said baffle plate for blowing said polymer dust against the inside of said screen to bring it into contact with said substrate.

12. Apparatus according to claim 1 wherein said reverse doctor blade is arranged so as to permit a portion of said excess polymer material to be carried along with said drum and fall through the openings thereof randomly on said substrate after said substrate leaves the bite of said drum.

13. Apparatus according to claim 12 and further including means to control the amount of polymer dust which is permitted to reach said substrate after falling through the openings of said drum.

14. Apparatus according to claim 13 wherein said means comprise a vacuum collection system placed adjacent said drum near the point where said substrate leaves the bite of said drum.

15. Apparatus according to claim 4 wherein said heating means comprises a heated drum to which said substrate is directed after leaving the surface of said printing drum.

* * * * *